United States Patent [19]

Yoshida et al.

[11] 4,250,243

[45] Feb. 10, 1981

[54] PHOTOGRAPHIC ELEMENT FOR COLOR DIFFUSION TRANSFER PROCESS

[75] Inventors: Takashi Yoshida; Shinji Sakaguchi, both of Minami-ashigara, Japan

[73] Assignee: Fuji Photo Film Co., Ltd., Minami-ashigara, Japan

[21] Appl. No.: 75,441

[22] Filed: Sep. 14, 1979

Related U.S. Application Data

[63] Continuation-in-part of Ser. No. 966,407, Dec. 4, 1978, abandoned.

[30] Foreign Application Priority Data

Dec. 2, 1977 [JP] Japan ..... 52-144749

[51] Int. Cl.[3] ..... G03C 1/40; G03C 1/48

[52] U.S. Cl. ..... 430/215; 430/216; 430/226

[58] Field of Search ..... 430/215, 216, 226

[56] References Cited

U.S. PATENT DOCUMENTS

| | | | |
|---|---|---|---|
| 3,455,686 | 7/1969 | Farney et al. | 430/215 |
| 3,575,701 | 4/1971 | Taylor | 430/236 |
| 3,592,645 | 7/1971 | Weyerts et al. | 430/236 |
| 3,856,522 | 12/1974 | George et al. | 430/215 |
| 4,054,722 | 10/1977 | Yoshida et al. | 430/216 |
| 4,123,275 | 10/1978 | Karino et al. | 430/216 |

*Primary Examiner*—J. Travis Brown

*Attorney, Agent, or Firm*—Sughrue, Rothwell, Mion, Zinn and Macpeak

[57] ABSTRACT

In a photographic element for the color diffusion transfer process including a neutralizing system for reducing the pH of an aqueous alkaline developing solution which comprises a neutralizing layer and a timing layer, wherein the timing layer is positioned on or under the neutralizing layer in direct or indirect contact therewith such that the aqueous alkaline developing solution reaches the neutralizing layer through the timing layer, the improvement which comprises the timing layer comprising a polymer latex which is produced by emulsion polymerization of (1) each of (A) at least one monomer selected from the group consisting of ethylene-type monomers having at least a free carboxylic acid group, a free sulfonic acid group or a free phosphoric acid group or a salt thereof, (B) at least one monomer selected from the group consisting of monomers represented by the following general formula (1)

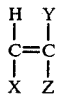

(I)

wherein X is a hydrogen atom, a methyl group or a —$COOR^1$ group; Y is a hydrogen atom, a methyl group or a —$(CH_2)_nCOOR^2$ group; Z is a monocyclic or bicyclic aryl group having 6 to 12 carbon atoms, a —$COOR^3$ group or a

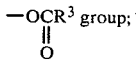

$R^1$, $R^2$ and $R^3$, which may be the same or different, each represents a saturated aliphatic group having 1 to 12 carbon atoms or a monocyclic or bicyclic aryl group having 6 to 12 carbon atoms; and n is an integer of 0 to 3, and (C) at least one monomer selected from the group consisting of ethylene-type monomers having at least one glycidyl group or (2) each of (A) at least one monomer selected from the group consisting of the ethylene-type monomers described in (A) above, (B) at least one monomer selected from the group consisting of monomers represented by the general formula (I) above, (C) at least one monomer selected from the group consisting of the ethylene type monomers described in (C) above, and (D) at least one monomer selected from the group consisting of monofunctional or polyfunctional unsaturated monomers other than those monomers described in (A), (B) and (C) above which are copolymerizable with the monomers described in (A), (B) and (C) above and selected from the group consisting of acrylamides, methacrylamides, vinyl ethers, vinyl ketones, allyl compounds, olefins, vinyl heterocyclic compounds, unsaturated nitriles and polyfunctional monomers, and the polymer latex layer per se has the water permeability.

19 Claims, No Drawings

PHOTOGRAPHIC ELEMENT FOR COLOR DIFFUSION TRANSFER PROCESS

This application is a continuation-in-part application of Ser. No. 966,407, filed Dec. 4, 1978, now abandoned.

BACKGROUND OF THE INVENTION

1. Field of the Invention

The present invention relates to a photographic element having a neutralizing system for a color diffusion process and particularly to a photographic element comprising a novel timing layer.

2. Description of the Prior Art

Hitherto, it is well known in the color diffusion transfer process to provide a neutralizing layer in order to decrease the pH after transferring diffusible dyes or dye developing agents to a mordanting layer as a result of development using an aqueous alkaline developing solution.

However, if the pH is rapidly decreased by providing a neutralizing layer, the development is interrupted. In order to prevent such a defect, it is also well known to utilize a layer which controls the reduction of the pH with time, namely a "timing layer", together with the neutralizing layer.

A neutralizing system containing these layers can be divided into two types, one type having a timing layer in which the water permeability is inversely proportional to the temperature and the other type having a timing layer in which the water permeability is directly proportional to the temperature.

The term "water permeability" used herein means the property of substantially passing an aqueous alkaline developing solution therethrough and the term "water impermeability" used herein means the property of substantially not passing an aqueous alkaline developing solution therethrough.

In using a timing layer in which the water permeability is inversely proportional to the temperature, the period of time at a high pH (preferably, a pH of about 10 or more) for developing silver halide and forming an imagewise distribution of diffusible dyes increases as the temperature increases. A neutralizing system having a timing layer which is temperature dependent is fundamentally suggested in U.S. Pat. No. 3,455,686. Further, materials for the timing layer, include polyvinyl amide type polymers described in U.S. Pat. Nos. 3,421,893 and 3,575,701. A neutralizing system having a timing layer wherein the above described materials are used where the period of time at high pH increases as the temperature increases is advantageously utilized for the color diffusion transfer process which has the disadvantages that the development rate of the diffusion rate of the dye developing agent is high and excessive amounts of dyes are adsorbed in the mordanting layer at low temperature, such as the color diffusion transfer process described in U.S. Pat. Nos. 2,983,606, 3,415,644 and 3,415,645.

On the other hand, a neutralizing system having a timing layer in which the water permeability is directly proportional to the temperature where the above-described period of time at a high pH decreases as the temperature increases is advantageously utilized for the color diffusion transfer process which uses dye image forming materials which are not diffusible initially but release a diffusible dye as a result of an oxidation-reduction reaction or a coupling reaction thereof with an oxidation product of the developing agent (hereinafter, materials of the former type are called "DRR compounds" and materials of latter type are called "DRR compounds") as described in U.S. Pat. Nos. 3,929,760, 3,928,312, 3,931,144, 3,932,381, 3,993,638 and 4,076,529. Namely, the delay of the development of silver halide and the delay of the above described oxidation-reduction reaction at a low temperature and the deterioration of densities of transferred color images caused by the delay of the diffusion of dyes can be corrected by prolonging the period of time at high pH (namely prolonging the period of time where developing of silver halide and releasing and transferring of the dyes can occur).

Examples of timing layers where the water permeability increases as the temperature increases are timing layers composed of polyvinyl alcohol as described in U.S. Pat. No. 3,362,819, layers described in U.S. Pat. No. 3,785,815 corresponding to Japanese Patent Application (OPI) No. 22935/74 (namely, timing layers containing a water impermeable continuous phase composed of a film forming polymer component produced from an aqueous film forming polymer dispersion and a water permeable heterogeneous phase) and layers described in *Research Disclosure* page 86, (November 1976) (namely, timing layers formed from a latex of methyl acrylate-vinylidene chloride-itaconic acid copolymers or acrylonitrile-vinylidene chloride-acrylic acid copolymers).

However, in the timing layers described in U.S. Pat. No. 3,785,815, the delay in development can not be sufficiently compesanted for, because the degree of the decrease of the permeability in the low temperature range is small. Further, in the timing layers described in *Research Disclosure,* supra, there is the defect that the cost of production is high, because it is necessary to use vinylidene chloride which requires special equipment for producing the polymer latex since it is hazardous to humans and gaseous at normal temperature. Further, when the thus-produced latex is used to form a film, it is necessary to use dry air having a high temperature at a step where the film is not sufficiently dried and, consequently, the timing layer causes various defects by rapid vaporizing of water. For example, spots sometimes occur in the resulting photographic images.

Furthermore, the following characteristics are required to a timing layer used in the color diffusion transfer process.

(1) Peeling off between a timing layer and an adjacent layer must not occur. If such peeling off occurs films or film units are cut during the manufacture thereof or developing.

(2) Where a coated surface of a timing layer of a photographic element and a film for heat seal are adhered using a hot melt type adhesive, the adhered surfaces must have a strong adhesion after the heat seal treatment. If the strength of adhesion is small a high speed mass-production of film units utilizing a heat seal treatment is impossible.

SUMMARY OF THE INVENTION

Accordingly, an object of the present invention is to eliminate the above-described various defects in prior known techniques and to provide a photographic element for the color diffusion transfer process which have a neutralizing system.

Another object of the present invention is to provide a timing layer of a photographic element for the color diffusion transfer process which is suitable for a high speed mass-production using a heat seal treatment and which does not cause the cutting problem of films of film units.

The above-described objects can be attained effectively by using a timing layer formed from a polymer latex (i.e., a film forming aqueous dispersion) which is produced by emulsion polymerization of (1) each of (A) at least one monomer selected from the group consisting of ethylene-type monomers having at least a free carboxylic acid group, a free sulfonic acid group of a free phosphoric acid group or a salt thereof, (B) at least one monomer selected from the group consisting of monomers represented by the following general formula (I)

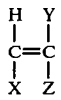

(I)

wherein X is a hydrogen atom, a methyl group or a —$COOR^1$ group; Y is a hydrogen atom, a methyl group or a —$(CH_2)_nCOOR^2$ group; Z is a monocyclic or bicyclic aryl group having 6 to 12 carbon atoms (e.g., a phenyl group, a p-methylphenyl group, a 1-naphthyl group, a 2-naphthyl group, etc.), a —$COOR^3$ group or a

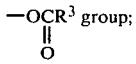

$R^1$, $R^2$ and $R^3$, which may be the same or different, each represents a saturated aliphatic group having 1 to 12 carbon atoms, preferably 1 to 4 carbon atoms or a monocyclic or bicyclic aryl group having 6 to 12 carbon atoms (e.g., a phenyl group, a p-methylphenyl group, a 1-naphthyl group, a 2-naphthyl group, etc.); and n is an integer of 0 to 3, and (C) at least one monomer selected from the group consisting of ethylene-type monomers having at least one glycidyl group or (2) each of (A) at least one monomer selected from the group consisting of the ethylene-type monomers described in (A) above, (B) at least one monomer selected from the group consisting of monomers represented by the general formula (I) above, (C) at least one monomer selected from the group consisting of the ethylene-type monomers described in (C) above, and (D) at least one monomer selected from the group consisting of monofunctional or polyfunctional unsaturated monomers other than those monomers described in (A), (B) and (C) above which are copolymerizable with the monomers described in (A), (B) and (C) above and selected from the group consisting of acrylamides, methacrylamides, vinyl ethers, vinyl ketones, allyl compounds, olefins, vinyl heterocyclic compounds, unsaturated nitriles and polyfunctional monomers, as the timing layer in a photographic element for the color diffusion trasfer process which has a neutralizing system for decreasing the pH of an aqueous alkaline developing solution where the neutralizing system comprises a neutralizing layer and a timing layer, and wherein the timing layer is positioned on or under the neutralizing layer in direct or indirect contact therewith in such a relation that the developing solution reaches the neutralizing layer through the timing layer.

DETAILED DESCRIPTION OF THE INVENTION

Monomers of (A), (B), (C) and (D) are illustrated in greater detail below.

The ethylene-type monomers (A), hereinafter Group (A) monomers, generally have 3 to 18 carbon atoms, may also contain alkoxycarbonyl groups having 1 to 13 carbon atoms in the alkoxy moiety (e.g., a methoxycarbonyl group, an ethoxycarbonyl group, a butoxycarbonyl group, an octoxycarbonyl group, etc.), monocyclic or bicyclic aryl groups (e.g., a phenyl group, a p-methylphenyl group, a 1naphthyl group, a 2-naphthyl group, etc.) and carbamoyl groups in addition to the above described carboxylic, sulfonic and phosphoric acid groups. Further, the above described acid groups may be linked directly to or may be linked through a divalent atom or atomic group (e.g., a methylene group, a

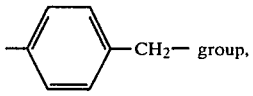

a group represented by the formula

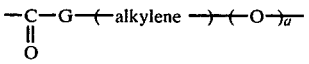

wherein G represents O or NH; and a is an integer of 0 or 1 and alkylene represents an alkylene group having 2 to 8 carbon atoms to the ethylene residue (moiety).

Examples of the monomers of Group (A) include the following monomers: acrylic acid, methacrylic acid, itaconic acid, maleic acid, monoalkyl itaconates (for example, monomethyl itaconate, monoethyl itaconate or monobutyl itaconate, etc.), monoalkyl maleates (for example, monomethyl maleate, monoethyl maleate, monobutyl maleate or monooctyl maleate, etc.), citraconic acid, styrenesulfonic acid, vinylbenzylsulfonic acid, vinylsulfonic acid, acryloyloxyalkyl sulfonic acids (for example, acryloyloxymethyl sulfonic acid, acryloyloxyethyl sulfonic acid, acryloyloxypropyl sulfonic acid and acryloyloxybutyl sulfonic acid, etc.), methacryloyloxyalkyl sulfonic acids (for example, methacryloyloxymethyl sulfonic acid, methacryloyloxyethyl sulfonic acid, methacryloyloxypropyl sulfonic acid and methacryloyloxybutyl sulfonic acid, etc.), acrylamido alkylalkane sulfonic acids (for example, 2-acrylamido-2-methylethanesulfonic acid, 2-acrylamido-2-methylpropanesulfonic acid and 2-acrylamido-2-methylbutanesulfonic acid, etc.), methacrylamido alkylalkane sulfonic acids (for example, 2-methacrylamido-2-methylethanesulfonic acid, 2-methacrylamido-2-methylpropanesulfonic acid and 2-methacrylamido-2-methylbutanesulfonic acid, etc.), (acryloyloxyalkyl)phosphates [for example, (acryloyloxyethyl)phosphate and (3-acryloyloxypropyl)phosphate, etc.] and (methacryloyloxyalkyl)phosphates [for example, (methacryloyloxyethyl)phosphate and (3-methacryloyloxypropyl)phosphate, etc.], etc.

Further, the alkyl moiety in the above-described monomers of Group (A) is, for example, one having 1 to 8 carbon atoms (e.g., a methyl group, an ethyl group, etc.). Those acids representative of monomers of Group (A), as ethylene-type monomers containing a carboxylic acid group, a sulfonic acid group or a phosphoric acid group may also be in the form of the alkali metal salts thereof (preferably, sodium salts or potassium) or the ammonium salts thereof.

Examples of suitable saturated aliphatic groups represented by $R^1$ to $R^3$ in the general formula (I), hereinafter Group (B) monomers, include straight, branched or cyclic alkyl groups which may be substituted or unsubstituted. These alkyl groups or the alkyl moieties thereof preferably have 1 to 12 carbon atoms.

Examples of substituents in the substituted alkyl groups include aryl groups having 6 to 12 carbon atoms (e.g., a phenyl group, a p-tolyl group, an o-tolyl group, a 1-naphthyl group, etc.), aryloxy groups having 6 to 12 carbon atoms (e.g., a phenoxy group, a p-methylphenoxy group, etc.), halogen atoms (e.g., chlorine, bromine, etc.), cyano groups, acyl groups having 2 to 8 carbon atoms (e.g., an acetyl group, a propionyl group, etc.), alkylcarbonyloxy groups having 2 to 10 carbon atoms (e.g., a methylcarbonyloxy group, an ethylcarbonyloxy group, etc.), arylcarbonyloxy groups having 8 to 14 carbon atoms (e.g., a phenylcarbonyloxy group, a p-tolylcarbonyloxy group, etc.), amino groups (including amino groups substituted with one or two alkyl groups and aryl groups), hydroxy groups, alkoxy groups, and heterocyclic residues (e.g., a 5- or 6-membered ring, which may be unsaturated or saturated and which may be condensed with an aromatic ring and in which the hetero atom includes one or more of an oxygen atom, a nitrogen atom and a sulfur atom, etc. such as a 2-pyridyl group, a 4-pyridyl group, etc.), etc.

Examples of suitable aryl groups represented by $R^1$ to $R^3$ in the general formula (I) include, of course, both unsubstituted and substituted phenyl and naphthyl groups. Examples of suitable substituents thereof include alkyl groups in addition to the substituents described above for the substituted alkyl group for $R^1$ to $R^3$.

Examples of the monomers of Group (B) include monomers such as acrylic acid esters, methacrylic acid esters, crotonic acid esters, vinyl esters, maleic acid diesters, fumaric acid diesters, itaconic acid diesters and styrenes, etc.

Further specific examples of these Group (B) monomers include monomers such as methyl acrylate, ethyl acrylate, n-propyl acryalte, isopropyl acrylate, n-butyl acrylate, isobutyl acrylate, sec-butyl acrylate, amyl acrylate, hexyl acrylate, 2-ethylhexyl acrylate, octyl acrylate, tert-octyl acrylate, 2-phenoxyethyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (mean polymerization degree of polyethylene glycol is about 9), 1-bromo-2-methoxyethyl acrylate, 1,1-dichloro-2-ethoxyethyl acrylate, methyl methacrylate, ethyl methacrylate, n-propyl methacrylate, isopropyl methacrylate, n-butyl methacrylate, isobutyl methacrylate, sec-butyl methacrylate, amyl methacrylate, hexyl methacrylate, cyclohexyl methacrylate, benzylmethacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 2-hydroxypropyl methacrylate, 4-hydroxybutyl methacrylate, triethyleneglycol monomethacrylate, dipropyleneglycol monomethacrylate, 2-methoxy ethyl methacrylate, 3-methoxybutyl methacrylate, 2-acetoxyethyl methacrylate, acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (mean polymerization degree of polyethylene glycol is about 6), vinyl acetate, vinyl propionate, vinyl butyrate, vinyl isobutyrate, vinyldimethylpropionate, vinyl ethylbutyrate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl β-phenyl butyrate, vinyl cyclohexylcarboxylate, vinyl benzoate, vinyl salicylate, vinyl chlorobenzoate, vinyl tetrachlorobenzoate, vinyl naphthoate, styrene, methylstyrene dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinylbenzoic acid methyl ester, butyl crotonate, hexyl crotonate, glycerin monocrotonate, dimethyl itaconate, diethyl itaconate, dibutyl itaconate, diethyl maleate, dimethyl maleate, dibutyl maleate, diethyl fumarate, dihexyl fumarate and dibutyl fumarate, etc.

Examples of the ethylene-type monomers (C), hereinafter Group (C) monomers include monomers having at least one glycidyl group; for example, glycidyl acrylate, glycidyl methacrylate, glycidyl p-vinylbenzoate, glycidyl crotonate, glycidyl α-chloracrylate, glycidyl itaconate, glycidyl methylene malonate and glycidyl maleate, etc.

Examples of the monomers other than those of Group (A), Group (B) and Group (C) and copolymerizable therewith (hereinafter Group (D) monomers) include acrylamide, methacrylamides, vinyl ethers, vinyl ketones, allyl compounds, olefines, vinyl heterocyclic compounds, unsaturated nitriles and polyfunctional monomers.

Specific examples of these Group (D) monomers include the following compounds:

acrylamides: for example, methylacrylamide, ethyl acrylamide, propylacrylamide, isopropylacrylamide, butylacrylamide, tert-butylacrylamide, hepthylacrylamide, tert-octylacrylamide, cyclohexylacrylamide, benzylacrylamide, hydroxymethylacrylamide, methoxyethylacrylamide, dimethylaminoethylacrylamide, hydroxyethylacrylamide, phenylacrylamide, hydroxyphenylacrylamide, tolylacrylamide, naphthylacrylamide, dimethylacrylamide, diethylacrylamide, dibutylacrylamide, di-isobutylacrylamide, N-(1,1-dimethyl-3-oxobutyl)acrylamide, methylbenzylacrylamide, benzyloxyethylacrylamide, β-cyanoethylacrylamide, acryloylmorpholine, N-methyl-N-acryloylpiperazine, N-acryloylpiperidine, N-acryloylglycine, N-(1,1-dimethyl-3-hydroxybutyl)-acrylamide, N-β-morpholinoethylacrylamide, N-acryloylhexamethyleneimine, N-hydroxyethyl-N-methylacrylamide, N-2-acetoamidoethyl-N-acetylacrylamide and acrylhydrazine, etc.

methacrylamides: for example, methylmethacrylamide, tert-butylmethacrylamide, tert-octylmethacrylamide, benzylmethacrylamide, cyclohexylmethacrylamide, phenylmethacrylamide, dimethylmethacrylamide, diethylmethacrylamide, dipropylmethacrylamide, hydroxyethyl-N-methylmethacrylamide, N-methyl-N-phenylmethacrylamide, N-ethyl-N-phenylmethacrylamide and methacrylhydrazine, etc.;

allyl compounds: for example, allyl acetate, allyl caproate, allyl caprylate, allyl laurate, allyl palmitate, allyl stearate, allyl benzoate, allyl acetoacetate, allyl lactate, allyloxyethanol, allyl butyl ether and allyl phenyl ether, etc.;

vinyl esters: for example, methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethylene glycol vinyl ether and dimethylaminoethyl vinyl ether, etc.;

vinyl ketones: for example, methyl vinyl ketone, phenyl vinyl ketone and methoxyethyl vinyl ketone, etc.;

olefins: for example, dicyclopentadiene, ethylene, propylene, 1-butene, 1-pentene, 1-hexene, 4-methyl-1-pentene, 1-heptene, 1-octene, 1-decene, 4-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,5,6-trimethyl-1-heptene, 1-dodecene and 1-octadecene, etc.;

vinyl heterocyclic compounds: for example, N-vinyloxazolidone, vinylpyridine, vinylpicoline, N-vinylimidazole, N-vinyl-2-methylimidazole, N-vinyltriazole, N-vinyl-3,5-dimethyltriazole, N-vinylpyrrolidone, N-vinyl-3,5-dimethylpyrazole, N-vinylcarbazole, vinylthiophene, N-vinylsuccinimide, N-vinylglutarimide, N-vinyladipinimide, N-methyl-N-vinylformamide, N-ethyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-ε-caprolactam and N-vinyl-2-pyridone, etc.;

unsaturated nitriles: for example, acrylonitrile and methacrylonitrile, etc.;

polyfunctional monomers: for example, divinylbenzene, diallylphthalate, methylene bisacrylamide ethyleneglycol dimethacrylate, ethylene glycol diacrylate, trimethylolpropane triacrylate and pentaerythritol trimethacrylate, etc.

Of these monomers, acrylic acid, methacrylic acid, itaconic acid, and 2-acrylamido-2-methylpropanesulfonic acid are preferred as the monomers of Group (A) from the standpoint of hydrophilic property, hydrophobic property and reactivity of the monomer, or stability and film-forming ability of the polymer latex, etc. Acrylic acid esters (e.g., methyl acrylate, ethyl acrylate, n-butyl acrylate, isobutyl acrylate, sec-butyl acrylate, etc.), methacrylic acid esters (e.g., methyl methacrylate, ethyl methacrylate, n-butyl methacrylate, isobutyl methacrylate, sec-butyl methacrylate, etc.), and styrenes are preferred as the monomers of Group (B). Glycidyl esters of acrylic acid and methacrylic acid (e.g., glycidyl acrylate, glycidyl methacrylate), 2-hydroxy-3-chloropropyl acrylate and 2-hydroxy-3-chloropropyl methacrylate are preferred as the monomers of Group (C).

The ratio of monomer components in the copolymers of the polymer latex can be appropriately changed depending on the characteristics desired for the photographic element for the color diffusion transfer process which has a timing layer made of the polymer latex. When the ratio of the Group (A) monomer component increases, the water permeability of the timing layer formed using the latex increases. A preferred amount of the Group (A) monomer component is in the range of about 1 to about 10% by weight of the solid content of the latex polymer. A particularly preferred amount of the Group (A) monomer component is in the range of 2 to 6% by weight of the solid content of the latex polymer. A preferred amount of the Group (B) monomer component is in the range of about 50 to about 99% by weight based on the solid content of the polymer latex and particularly 80 to 99% by weight. A preferred amount of the Group (C) monomer component is in the range of 0.1 to about 40% by weight and particularly 5 to 20% by weight of the solid content of the polymer latex. A preferred amount of the Group (D) monomer component is in the range of 0 to about 49% by weight and particularly 0 to 19% by weight of the solid content of the polymer latex.

The ratio of the above described monomer components is based on the relative ratio of monomers added to a polymerization reactor in the conventional free radical polymerization process.

Typical examples of preferred latex polymers composing the timing layer of the present invention include the following materials, but the present invention is not to be construed as being limited to these examples.

(1) Ethyl methacrylate-acrylic acid-glycidyl methacrylate copolymer: (87:3:10)
(2) Propyl methacrylate-acrylic acid-glycidyl acrylate copolymer: (84:4:12)
(3) n-Butyl methacrylate-acrylic acid-glycidyl acrylate copolymer: (84:4:12)
(4) sec-Butyl methacrylate-acrylic acid-glycidyl methacrylate copolymer: (77:3:20)
(5) tert-Butyl methacrylate-acrylic acid-glycidyl acrylate copolymer: (83:2:15)
(6) n-Butyl methacrylate-itaconic acid-glycidyl acrylate copolymer: (95:2.5:2.5)
(7) Cyclohexyl methacrylate-acrylic acid-glycidyl acrylate copolymer: (77:3:20)
(8) Tetrahydrofurfuryl methacrylate-acrylic acid-glycidyl acrylate copolymer: (78:4:18)
(9) 2-Acetoxyethyl methacrylate-acrylic acid-glycidyl methacrylate copolymer: (87:3:10)
(10) Ethyl acrylate-methacrylic acid-glycidyl methacrylate copolymer: (80:10:10)
(11) Benzyl acrylate-acrylic acid-glycidyl methacrylate copolymer: (80:4:16)
(12) Propyl methacrylate-maleic acid-glycidyl acrylate copolymer: (79:1:20)
(13) n-Butyl methacrylate-sodium vinylbenzylsulfonate-glycidyl-p-vinylbenzoate copolymer: (66:9:25)

(14) Ethyl acrylate-2-acrylamido-2-methylpropanesulfonic acid-glycidyl acrylate copolymer: (63:7:30)
(15) n-Propyl methacrylate-sodium 2-methacryloyloxyethylsulfonate-glycidyl maleate copolymer: (87:8:5)
(16) n-Butyl methacrylate-monoethyl itaconate-glycidyl itaconate copolymer: (84:7:9)
(17) sec-Butyl methacrylate-2-methacryloyloxyethylphosphateglycidyl acrylate copolymer: (80:9:11)
(18) Styrene-n-butyl acrylate-acrylic acid-glycidyl acrylate copolymer: (47.9:38.1:2:12)
(19) Styrene-n-butyl acrylate-acrylic acid-glycidyl acrylate copolymer: (46.8:37.2:4:12)
(20) Styrene-ethoxyethyl acrylate-acrylic acid-glycidyl acrylate copolymer: (43:43:4:10)
(21) Styrene-n-butyl acrylate-itaconic acid-glycidyl methacrylate copolymer: (44:42:3:11)
(22) Styrene-n-butyl acrylate-itaconic acid-glycidyl methacrylate copolymer: (40:38:8:14)
(23) Styrene-n-butyl acrylate-acrylic acid-glycidyl methacrylate copolymer: (44.2:34.8:6:15)
(24) Styrene-n-butyl acrylate-acrylic acid-glycidyl methacrylate copolymer: (44.6:35.4:8:12)
(25) Styrene-ethyl acrylate-2-acrylamido-2-methylpropanesulfonic acid-glycidyl crotonate copolymer: (38:48:12:2)
(26) Methyl methacrylate-n-butyl methacrylate-itaconic acid-glycidyl acrylate copolymer: (10:80:3:7)
(27) Benzyl methacrylate-2-ethylhexyl acrylate-acrylic acid-glycidyl methacrylate copolymer: (50:32:5:13)
(28) n-Butyl methacrylate-2-hydroxyethyl methacrylate-acrylic acid-glycidyl acrylate copolymer: (63:5:5:27)
(29) n-Butyl methacrylate-acrylic acid-2-acrylamido-2-methylpropanesulfonic acid-glycidyl acrylate copolymer: (54:2:4:40)
(30) Benzyl methacrylate-vinyl acetate-acrylic acid-glycidyl methacrylate copolymer: (30:60:4:6)
(31) Vinyltoluene-ethoxyethyl acrylate-acrylic acid-glycidyl methacrylate copolymer: (45:40:3:12)
(32) Styrene-dibutyl maleate-maleic acid-glycidyl α-chloracrylate copolymer: (50:44:3:3)
(33) n-Butyl methacrylate-N-(1,1-dimethyl-3-oxobutyl)-acrylamide-acrylic acid-glycidyl methacrylate copolymer: (60:30:3:7)
(34) n-Butyl methacrylate-acrylonitrile-acrylic acid-glycidyl acrylate copolymer: (75:10:7:8)
(35) Styrene-n-butyl acrylate-acrylic acid-divinylbenzeneglycidyl acrylate copolymer: (42:40:3:3:12)
(36) Tetrahydrofurfuryl methacrylate-ethyl acrylate-acrylic acid-glycidyl acrylate-glycidyl crotonate copolymer: (55:30:4:7:4)
(37) n-Butyl methacrylate-acrylic acid-glycidyl acrylate copolymer: (82.5:2.5:15)
(38) Ethyl methacrylate-itaconic acid-glycidyl methacrylate copolymer: (90:2:8)

All ratios in the above examples are by weight and ratios of the amount of each monomer added in a synthesis of the polymer latex.

The polymer latex used in the present invention can be synthesized using processes well known to those skilled in the art of synthesizing polymers. The polymer latex can be easily synthesized with reference to the descriptions appearing in the present specification and in, e.g., U.S. Pat. Nos. 2,914,499, 3,033,833 and 3,547,899, Canadian Pat. No. 704,778 and U.S. patent application Ser. No. 859,636 filed Dec. 12, 1977 corresponding to Japanese Patent Application 148589/76, etc. The typical examples of polymer latexes described above can be synthesized in a manner similar as described in Synthesis Examples 1, 3 and 5 of the above-described U.S. patent application Ser. No. 859,636.

The average particle size of latexes for the timing layer of the present invention are preferably about 0.05 to about 0.4μ and particularly 0.05 to 0.2μ. However, the average particle size can be suitably adjusted according to the purpose of the timing layer and there is no limination on the average particle size. (The average particle size is the number mean of the diameter of the particles measured microscopically in the conventional manner.)

The timing layer can be produced by applying at least one of the polymer latexes produced by the above described processes just as it is or after dilution with water to the neutralizing layer directly or indirectly. As used herein, the term "indirectly" means that the timing layer of the present invention is applied to the neutralizing layer through another timing layer (for example, a cellulose acetate layer) or an adhesion improving layer, etc.

Suitable solid content of the polymer latex in the coating solution is about 5 to about 30% by weight, preferably 5 to 15% by weight and most preferably 5 to 12% by weight based on the coating solution.

A preferred thickness of the timing layer is about 0.5 to about 5 μm, most preferably 1 to 3 μm. It is preferred that the thickness of the timing layer be adjusted depending on the kind of latex used and the level of permeability desired.

Examples of adhesion improving layers, include layers containing a hydrophilic colloid such as gelatin or polyvinyl alcohol, etc. These layers may function as the timing layer.

The photographic element of the present invention may be a cover sheet for covering the "photosensitive element" (but the neutralizing system is incorporated therein) or may be a so-called laminated film unit which comprises a support, a photosensitive member comprising an "image receiving element" and a "photosensitive element", a "cover sheet" having a neutralizing system and a "processing element" which is provided so that it can be spread between the photosensitive element and the cover sheet, which are applied to the support in turn to form the film unit (but these elements may be strippable, if desired).

Further, the photographic element of the present invention may be a so-called strippable film unit which can be utilized as a negative, wherein a developing solution is spread between an image receiving element applied to a support and an element comprising a neutralizing layer, a timing layer and a photosensitive element applied to a support in this order.

Further, the neutralizing system of the present invention may be present in the image receiving element, although such an embodiment is less preferred than the other embodiments.

The timing layer of the present invention is essentially different from the timing layer described in U.S. Pat. No. 3,785,815 in the following characteristics.

| Timing Layer | Layer made of Polymer Latex Dispersion | Addition of Component which Renders the Film Water Permeable |
|---|---|---|
| Prior art | Water impermeable | Addition of a water soluble polymer is indispensable |
| Present | Water permeable | Addition of a water |

-continued

| Timing Layer | Layer made of Polymer Latex Dispersion | Addition of Component which Renders the Film Water Permeable |
|---|---|---|
| invention | | soluble polymer is not essential (in fact such is preferably not present). |

In the latex used in the present invention, surface active agents used for emulsifying monomers during the synthesis of the latex are present (examples of which are described hereinafter). Since water soluble materials are used as such surface active agents, a possible misunderstanding is that the surface active agents function as a water permeable discontinuous phase coexistent with a water impermeable continuous phase as described in U.S. Pat. No. 3,785,815 may arise. Accordingly, it is to be emphasized in the present invention that the surface active agents for emulsification can not be the water permeable discontinuous phase. The reason for this is described below. When the relationship between the function (water permeability) as the timing layer and the amount of the surface active agent used for preparation of the latex of the present invention is plotted graphically, while the amount of the surface active agent used is reduced, it has been found that the water permeability does not depend upon the amount of the surface active agent used, because the amount of the surface active agent added in preparation of the latex is essentially very small (about 0.5 to at most 6% by weight based on the solid content of the latex polymer). Accordingly, this demonstrates that, although the timing layer of the present invention contains a water soluble emulsifying agent in the starting materials used, such an emulsifying agent does not increase the water permeability of the timing layer. Further, in U.S. Pat. No. 3,785,815, since the surface active agent is not exemplified as the water permeable discontinuous phase, it is supposed that the surface active agent added at preparation of the latex is not the above described discontinuous phase.

The latex for the timing layer of the present invention can be provided by known methods, for example, using a spiral rod coater, an extrusion coater, a dip coater or an air knife coater, etc.

Various kinds of additives may be added to this latex, according to the purpose thereof.

As such additives, it is preferred to use about 0.1 to about 1.0% by weight (based on the weight of solid content) of surface active agents for improving wetting at coating, solvents facilitating film formation (for example, methyl Cellosolve, ethyl Cellosolve, cyclohexanone, toluene, etc.), matting agents which are used for preventing adhesion at preparation or at use, such as silica powder or polymer beads, etc., bulking agents for improving the strength of the film (for example, colloidal silica, titanium dioxide, carbon black or diatomaceous earth, etc.) and plasticizers for improving the flexibility of the film (for example, phthalic acid esters such as dibutyl phthalate or dihexyl phthalate, etc. and phosphoric acid esters such as trialkyl phosphates or tricresyl phosphate, etc.), etc. according to the purpose. A preferred amount of the above described surface active agents for improving wetting ranges from about 0.05 to about 0.5% (by weight). Although the amounts of these other additives can be suitably decided according to the purpose, a preferred amount of each of the additives ranges from about 0.1 to about 20% (by weight) and particularly 1 to 10% (by weight) based on the solid content of the latex polymer.

In the timing layer of the present invention, the polymer latex according to the present invention can be used together with one or more other polymer latexes which are compatible with the polymer latex according to the present invention, if desired. For example, polymer latex which has characteristic such as improving the flexibility of the layer or improving the slippability of surface of the layer, etc. (e.g., polyolefin latexes, polystyrene latexes, polyacrylic acid ester latexes, etc.) can be used. In such a case, the other polymer latex can preferably used in an amount from about 0.1 to about 200% (by weight) and particularly 1 to 100% (by weight) based on the amount of the latex polymer according to the present invention, although the amount of the other polymer latex is not restricted.

Although the thickness of the timing layer of the present invention advantageously ranges from about 0.5 to about 20$\mu$ and particularly 2 to 8$\mu$, there is no limitation on the thickness. It can be suitably decided according to the purpose of using the timing layer.

In order to dry the timing layer of the present invention on coating, a method of using electromagnetic waves such as infrared rays or ultrasonic waves, etc., a contact heat-transmission method using a heating drum, or a method of using hot air can be suitably utilized. In any case, it is preferred for a transparent film to be produced from the latex by applying energy which is slightly in excess of the minimum energy necessary to form a transparent film and to complete the reaction of the crosslinking group (i.e., glycidyl group or a precursor thereof) and then the residual volatile components such as water or other materials are evaporated by applying sufficiently high energy. If an excess amount of energy is employed before sufficient film formation has occurred, the volatile components such as water sometimes rapidly evaporate and boiling occurs. In such a case, the resulting timing layer has many defects, such as pores, etc. In these defective areas the permeation rate of the alkaline solution becomes markedly higher than that in the other areas and, consequently, spots are formed sometimes on the photographic images. Since the latex for the timing layer of the present invention forms a transparent film at a comparatively low temperature, a quite uniform defect-free film can be produced, if the drying is carreid out in the above described manner as recommended herein.

As described above, the condition for the drying during film formation of the timing layer used in the present invention are particularly important and it is preferred that the method used be of a system which permits of applying energy to the timing layer uniformly. A method of using hot air is suited for uniform dyring. When hot air is used, drying is suitably conducted at about 80° to about 130° C. at air speed of about 2 to about 5 m/sec for about 1.5 to about 5 minutes. In the practice of the present invention, it is preferred that the drying conditions during film formation of the polymer latex timing layer according to the present invention are adjusted according to the composition of latex and the thickness of timing layer within the range wherein the polymer latex layer formed maintains the water permeability.

The timing layer of the present invention not only can control the rate of alkali absorption by the neutralizing layer but also can control migration by diffusion of materials in the layers which are positioned on the opposite side of silver halide emulsion layers on the basis of the timing layer.

An example of a layer which is positioned on the opposite side is the neutralizing layer. The neutralizing layer is illustrated below. It is preferred to previously add to the neutralizing layer development inhibiting agents or precursors thereof (development inhibitor releasing type couplers and hydroquinones, and compounds which release a development inhibitor by hydrolysis as described in French Pat. No. 2,282,124) or reducing agents for preventing fading by light, which cause dis-advantageous chemical reactions if they move into the silver halide layers in the initial stage of the development. However, by application of the timing layer of the present invention, it becomes possible to block the migration of these materials so that they do not reach the silver halide emulsion layers in the initial stage of the development and they function after sufficient development has progressed. Of course, it is possible to control the effect of these additives by temperature. For example, when a development inhibiting agent or a precursor thereof for inhibiting excessive development is added to the neutralizing layer, the development is not inhibited at the beginning of the development at any temperature but it is inhibited after sufficient development has progressed to finally stop the development. Accordingly, it becomes possible to prevent the occurrence of stains or prevent an increase of the image densities caused by excessive development. Particularly, when the development temperature is high, stains easily occur due to excessive development, since the development rate is high. In such a case, if the timing layer of the present invention which has the characteristic that the permeability markedly increases as the temperature increases is used, the above described disadvantages are suitably prevented.

Development inhibitor releasing type couplers (DIR coupler), which can be used herein, include those described in, for example, U.S. Pat. Nos. 3,227,554, 3,617,291, 3,701,783, 3,790,384 and 3,632,345, German Patent Applications (OLS) Nos. 2,414,006, 2,454,301 and 2,454,329, British Pat. No. 953,454 and Japanese Patent Application (OPI) No. 69624/77.

Other compounds which release a development inhibitor during development which can be used, are those described in, for example, U.S. Pat. Nos. 3,297,445 and 3,379,529 and German Patent Application (OLS) No. 2,417,914.

When the timing layer of the present invention is used, the effect of maintaining a high pH for a long period at a lower temperature is particularly excellent. Further, since a reduction in the transfer image densities is nearly completely corrected for by adjusting suitably the time for maintaining such a high pH, it is possible to obtain fixed transfer image densities in spite of a variation in the processing temperature.

Further, when the timing layer of the present invention is used, since the water permeability is markedly increased as the temperature increases, it is possible to obtain an effect where the permeation rate of water increases 2.5 times or more with every 10° C. increase in the temperature where the temperature is the range of about 0° C. to about 40° C. By this effect, since the processing solution easily reaches the neutralizing layer by passing through the timing layer of the present invention at high temperature, there is the advantage that the pH of the processing solution is rapidly decreased to inhibit excessive development, namely, the formation of excess transfer images can be prevented.

Further, the timing layer used in the present invention has a high film strength and thus the timing layer does not cut at the surfaces between adjacent layers when mechanical actions are applied to the timing layer from outside. Therefore, the films or film units including the timing layer according to the present invention have improved properties that the peeling off or the cutting of the films or film units during the manufacture thereof or photographing is high prevented. Furthermore, the timing layer used in the present invention has a feature in that the adhesion strength after a heat seal treatment using a hot melt type adhesive is extremely high and thus a high speed mass-production of film units utilizing a heat seal treatment can be easily carried out.

As a hot melt type adhesive which can be used in a heat seal treatment of photographic elements including the timing layer according to the present invention, any hot melt type adhesive conventionally employed can be used. The heat seal treatment is carried out by contacting a support coated a hot melt type adhesive and the timing layer of the photographic element according to the present invention in a face to face relationship and putting between preheated metal blocks.

Examples of hot melt type adhesives used in the heat seal treatment to the timing layer according to the present invention include polyethylene-vinyl acetate type adhesives, adhesives described in *Research Disclosure* Vol. 158, No. 15839 (June, 1977). Such adhesives are preferably used by coating on a polyethylene terephthalate film, a polycarbonate film or a triacetyl cellulose film, etc. The strength against peeling off after the heat seal treatment can be easily determined using a conventional stretching tester.

Furthermore, there is the advantage that the cost of production is very low, because the latex used in the present invention can be produced from inexpensive starting materials using simple equipment. Further, if the latex of the present invention is used, drying after application is gradually carried out at a comparatively low temperature when water is present in the film in a large amount to form a film having less defects and the drying is then carried out at a high temperature by which latex particles sufficiently fuse to complete the film of the timing layer. Accordingly, there is the advantage that causing defects in the photographic images can be minimized.

The effect of the timing layer of the present invention which has a characteristic that water permeability markedly increases as the temperature increases can be carried out by the correspondence between the variation of photographic development by temperature and variation of water permeability by temperature.

The water permeability of the timing layer is preferably described as the time required for the pH of the alkaline processing solution to decrease on passing through the timing layer and being absorbed in the neutralizing layer.

In this case, when the time required for the pH to reach 10 (it is understood in the photographic art that photographic development is substantially stopped at this pH) is measured, it has been found that there is a very good correspondence between the change in temperature and the change in transfer image densities with temperature. Although the time required for a pH of 10 to be reached can be electrically measured using a glass electrode for measuring pH which has been modified for such a purpose, it is preferred to measure the time using a pH indicating dye which does not decompose under alkaline conditions. It is particularly preferred to measure using Thymolphthalein which is a dye whose color changes at a pH of 10 as the pH indicator as described in the following examples.

When the variation of the time it takes the pH of the alkaline processing solution decreases to a pH of 10 is measured for the timing layer of the present invention with the temperature and prior art timing layers using Thymolphthalein using the method shown in Examples hereinafter of the present invention, it has been found that the variation of time with temperature has a clear relationship to the variation of image transfer densities with temperature. It is preferred for the measurement temperature to be 25° C. which is a normal temperature and 15° C. and a preferred embodiment of the timing layer of the present invention is prescribed on the basis of the ratio of the time required for reaching a pH of 10 at 15° C. to that at 25° C., namely, $T_{15}/T_{25}$ ($T_{15}$ and $T_{25}$ are each the time required for reaching a pH of 10 at 15° C. or at 25° C.).

It is preferred for the value of $T_{15}/T_{25}$ measured according to the method described in Example 1 given hereinafter to be in the range of about 250 to about 600% and, particularly, 300 to 500%.

In the timing layer described in U.S. Pat. No. 3,785,815 discussed above, this range can not be obtained and, consequently, the temperature dependence of the transfer image densities is large when such a timing layer is used.

The silver halide emulsion which can be used in the present invention are hydrophilic colloid dispersions of silver chloride, silver bromide, silver bromochloride, silver bromoiodide, silver iodobromochloride or a mixture thereof. Although the composition of halides is suitably selected according to the purpose or processing conditions of the light-sensitive materials, a silver iodobromide or silver iodobromochloride having an iodine content of about 1% by mol to about 10% by mol (a chloride content of about 30% by mol or less) and the balance of bromide is particularly preferred. Although the grains of the silver halide used may have a conventional grain size or a micrograin size, it is preferred for the average grain size thereof to range from about 0.1 micron to about 2 microns. It is further preferred for the grain size of each grain to be uniform. The grain used may have a cubic crystal form, an octahedral crystal form or a mixed crystal form thereof. These silver halide emulsions can be produced using conventional techniques as described in, for example, P. Glafkides, *Chimie Photographique* Chapters 18–23, 2nd Edition, Paul Montel, Paris (1957).

It is preferred for the silver halide emulsions used in the present invention to be chemically sensitized by heat treatment using the natural sensitizing agents present in gelatin, sulfur sensitizing agents such as sodium thiosulfate or N,N,N'-triethyl thiourea, gold sensitizing agents such as the thiocyanate complex salt or the thiosulfate complex salt of monovalent gold, or reduction sensitizing agents such as stannous chloride or hexamethylenetetramine. In the present invention, although emulsions wherein grains easily form latent images on the surface thereof may be used, it is preferred to use internal latent image type direct reversal emulsions as described in U.S. Pat. Nos. 2,497,875, 2,588,982, 2,456,953, 3,761,276, 3,206,313, 3,317,332, 3,761,266, 3,850,637, 3,923,513, 3,736,140, 3,761,267 and 3,854,949.

The silver halide emulsions used in the present invention may be stabilized using conventional stabilizers. Further, the silver halide emulsions used may contain sensitizing compounds such as polyethylene oxide compounds.

The silver halide emulsions used in the present invention may be spectrally sensitized, if desired. Useful spectral sensitizing agents include dyes such as cyanines, merocyanines, holopolar cyanines, styryls, hemicyanines, oxanols and hemioxonols, etc. Examples of spectral sensitizing agents are described in P. Glafkides supra, Chapters 35–41 and F. M. Hamer *Cyanine Dyes and Related Compounds,* Interscience (1964). Particularly, cyanines wherein a nitrogen atom in the basic heterocyclic nuclei is substituted with an aliphatic group (for example, an alkyl group) having a hydroxy group, a carboxyl group or a sulfo group, such as those described in U.S. Pat. Nos. 2,503,776, 3,459,553 and 3,177,210 are advantageously used for practicing the present invention.

Suitable color image forming materials for the diffusion transfer process used in combination with the photographic emulsions of the present invention are the compounds described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144 and 3,932,381, British Pat. Nos. 840,731, 904,364 and 1,038,331, German Patent Applications (OLS) Nos. 1,930,215, 2,214,381, 2,228,361, 2,242,762, 2,317,134, 2,402,900, 2,406,626 and 2,406,653 and Japanese Patent Applications (OPI) Nos. 114,424/74, 126332/74, 33826/73, 126331/74, 115528/75, 113624/76 and 104343/76, etc. Particularly, DRR compounds are preferred for use.

Examples of DRR compounds include 1-hydroxy-2-tetramethylenesulfamoyl-4-[3'-methyl-4'-(2''-hydroxy-4''-methyl-5''-hexadecyloxyphenylsulfamoyl)-phenylazo]naphthalene as a magenta image forming material, and 1-phenyl-3-cyano-4-{3'-[2''-hydroxy-4''-methyl-5''-(2''',4'''-di-t-pentylphenoxyacetamido)-phenylsulfamoyl]-phenylazo}-5-pyrazolone as a yellow image forming material in addition to the compounds described in the above mentioned patents.

In the present invention, in using DRR compounds, any silver halide developing agent can be used if such is capable of oxidizing DRR compounds. Such a developing agent may be incorporated in the alkaline processing compositions (processing element) or may be incorporated in a suitable layer in the photosensitive element. Examples of developing agents which can be used in the present invention include the following compounds: hydroquinone, aminophenols such as N-methylaminophenol, 1-phenyl-3-pyrazolidone, 1-phenyl-4,4-dimethyl-3-pyrazolidone, 1-phenyl-4-methyl-4-oxymethyl-3-pyrazolidone, N,N-diethyl-p-phenylenediamine, 3-methyl-N,N-diethyl-p-phenylenediamine and 3-methoxy-N-ethoxy-p-phenylendiamine, etc.

Of these compounds, black-and-white developing agents having the ability to reduce stain formation of the image-receiving layer (mordanting layer) are particularly preferred.

In carrying out the present invention, in using DRR compounds, positive images are formed as the transfer images and negative images are formed as the residual images, if the so-called common emulsions wherein the development is carried out according to exposure are used. On the other hand, positive images are obtained on the image receiving element of the film unit, if the so-called direct reversal silver halide emulsions wherein the development is carried out in the non-exposed areas (for example, internal latent image type emulsions or solarization type emulsions, etc.) are used.

Solarization type emulsions, as described in C. E. K. Mees, *The Theory of the Photographic Process,* pages 261–297, McMillan Co., New York, (1942) are useful. Processes for producing these types of emulsions are described, for example, in British Pat. Nos. 443,245 and 462,730 and U.S. Pat. Nos. 2,005,837, 2,541,472, 3,367,778, 3,501,305, 3,501,306 and 3,501,307.

The internal latent image type direct positive emulsions advantageously used in the present invention are described in U.S. patents described above.

The direct reversal photographic emulsions used in the present invention can be used to form positive images directly by conducting the development in the presence of a fogging agent after imagewise exposing to light or by fogging by applying a uniform exposure (a high illuminance exposure for a short time, namely, exposure for $10^{-2}$ seconds or less, or a low illuminance exposure for a long time) in surface development processing after imagewise exposing to light, as described in U.S. Pat. No. 2,456,953. It is preferred to use a fogging agent because the degree of fogging can be easily controlled. Although the fogging agent may be added to the developing solution, it is more preferred to incorporate the fogging agent in the light sensitive material. Suitable fogging agents which can be used in emulsions, include hydrazines described in U.S. Pat. Nos. 2,588,982 and 2,568,785, hydrazides and hydrazones described in U.S. Pat. No. 3,227,552, and quaternary salt compounds described in British Pat. No. 1,283,935, Japanese Patent Publication No. 38164/74 and U.S. Pat. Nos. 3,734,738, 3,719,494 and 3,615,615.

The amount of the fogging agent used here can be widely changed depending on the results required. Where the fogging agent is added to the light-sensitive materials, the fogging agent is generally used in a range of about 50 mg to about 10 g/mol of Ag and preferably 300 mg of 5 g/mol of Ag.

Where the fogging agent is added to the developing solution, the fogging agent is generally used in a range of about 0.05 to 5 g, preferably 0.1 to 1 g, per liter of the developing solution. Where the fogging agent is incorporated in a layer in the light-sensitive material, it is effective for the fogging agent to be rendered non-diffusible. A ballast group commonly used for couplers can be linked to the fogging agent to render it non-diffusible.

Further, diffusion transfer positive images can be also obtained using a DIR reversal emulsion process as described in U.S. Pat. Nos. 3,227,551, 3,227,554 and 3,364,022 or a reversal emulsion process by solution physical development as described in British Pat. No. 904,364. Processes for forming color diffusion transfer images are described in U.S. Pat. Nos. 3,227,550 and 3,227,552 and British Pat. No. 1,330,524, etc.

Suitable and typical color developing agents which can be used with DDR couplers in the present invention are p-phenylenediamine derivatives described in U.S. Pat. Nos. 3,227,552, 2,559,643 and 3,813,244. Further, p-aminophenol derivatives as described in Japanese Patent Application (OPI) No. 26134/73 can be advantageously used. Such color developing agents are preferably added to an alkaline processing composition for development retained in a rupturable container. The color developing agent may be added to a layer provided on a photosensitive element of the film unit or may be added to the same silver halide emulsion layer.

The image receiving element should have a mordanting layer composed of a mordanting agent such as poly-4-vinylpyridine-latex (particularly, in polyvinyl alcohol) as described in U.S. Pat. No. 3,148,061, polyvinylpyrrolidone as described in U.S. Pat. No. 3,003,872 and polymers containing quaternary ammonium salt groups or phosphonium salt groups as described in U.S. Pat. Nos. 3,239,337, 3,958,995, 3,770,439 and 3,898,088 and German Patent Application (OLS) No. 2,264,073, etc. The basic polymers described in U.S. Pat. Nos. 2,882,156, 3,625,694 and 3,709,690 are also effective as mordanting agents. In addition, mordanting agents described in U.S. Pat. Nos. 2,484,430, 3,271,147, 3,184,309 and 3,271,147, etc. are also effective.

The photosensitive element used in the present invention has a support which does not undergo any marked dimensional change during processing. Examples of such supports include cellulose acetate films, polystyrene films, polyethylene terephthalate films and polycarbonate films, etc. In addition, examples of effective supports include paper and laminated paper, whose surface is covered with a water impermeable polymer such as polyethylene.

Typical examples of preferred acid materials such as polymeric acids, etc., composing the neutralizing layer used in the present invention include materials described in U.S. Pat. Nos. 2,983,606, 2,584,030 and 3,362,819. The neutralizing layer may contain polymers such as cellulose nitrate or polyvinyl acetate and a plasticizer as described in U.S. Pat. No. 3,557,237 in addition to the acid materials. The acid materials may be incorporated into the film unit in the form of microcapsules as described in German Patent Application (OLS) No. 2,038,254.

The processing composition used in the present invention is a liquid composition containing processing components necessary for the development of the silver halide emulsions and for formation of the diffusion transfer dye images, wherein the solvent is mainly water and may contain hydrophilic solvents such as methanol or methyl Cellosolve. The processing composition contains an alkali in an amount sufficient to maintain the pH required for the development of the emulsion layers and to neutralize acids (for example, hydrohalic acids such as hydrobromic acid or carboxylic acids such as acetic acid, etc.) formed during the steps of development and dye image formation. Examples of alkalis which can be used include lithium hydroxide, sodium hydroxide, potassium hydroxide, a dispersion of calcium hydroxide, alkali metal salts of weak acids or alkaline earth metal salts of weak acids and amines such as tetramethylammonium hydroxide, sodium carbonate, trisodium phosphate or diethylamine, etc. It is preferred to add an alkali in such a concentration that the pH becomes about 10 or more and preferably 12 or more at room temperature. A further preferred processing composition contains hydrophilic polymers having a high molecular weight such as polyvinyl alcohol, hydroxyethyl cellulose or sodium carboxymethyl cellulose. These polymers not only provide the processing composition with a viscosity of more than about 1 poise and preferably a viscosity in the range of several hundred (500–600) to 1000 poises at room temperature which facilitates a uniform spreading of the composition at processing but also form a nonfluid film to help unify the film unit after processing when the composition was concentrated by diffusion of the aqueous solvent into the photosensitive element and the image-receiving element during processing. After the formation of the diffusion transfer dye images is substantially completed, this polymer film inhibits movement of coloring components into the image-receiving layer to prevent a deterioration of the images.

It is sometimes advantageous for the processing composition to contain light absorbing materials such as $TiO_2$, carbon black or a pH indicator or desensitizing agents described in U.S. Pat. No. 3,579,333 in order to prevent fogging of the silver halide emulsion by ambient light during processing, e.g., outside a camera. Further, development inhibiting agents such as benzotriazole may be added to the processing composition, if desired.

It is preferred for the above described processing composition to be used in a rupturable container, e.g., as described in U.S. Pat. Nos. 2,543,181, 2,643,886, 2,653,732, 2,723,051, 3,056,491, 3,056,492 and 3,152,515, etc.

The photographic film unit of the present invention, namely, a film unit capable of being processed by passage through a pair of opposing pressure applying members, comprises the following elements:

(1) a photosensitive element as described above, (2) an image receiving element as described above, and (3) means for releasing the alkaline processing composition in the interior of the film unit, such as a rupturable container, and containing a silver halide developing agent.

The photosensitive element in the above described film unit is superposed on the image receiving element in a face-to-face relationship after exposure to light, and is processed by spreading the alkaline processing composition between these two elements. In this case, the image receiving element may be stripped off (delaminated) after completion of the diffusion transfer process. Further, the film unit may be of the type where the image can be observed without stripping off the image receiving element, e.g., as described in U.S. Pat. No. 3,415,645.

In another embodiment, the image receiving layer in the above described film unit may be arranged in a photosensitive element comprising a support and a photosensitive silver halide emulsion layer. For example, as described in Belgian Pat. No. 757,960, an image receiving layer, a substantially opaque light-reflection layer (for example, a $TiO_2$ layer and a carbon black layer) and a photosensitive layer composed of one or more light-sensitive elements are applied to a transparent support, can be effectively used. After the light-sensitive element is exposed to light, the light-sensitive element is superposed on an opaque cover sheet (which includes the neutralizing system of the present invention) in a face-to-face relationship and the processing composition is spread therebetween.

Another embodiment which is an integral type embodiment capable of being utilizing in the present invention is described in Belgian Pat. No. 757,959. According to this embodiment, an image receiving layer, a substantially opaque light reflection layer (for example, as described above) and one or more photosensitive layers are applied to a transparent support and a transparent cover sheet (which includes the neutralizing system of the present invention) is superposed thereon in a face-to-face relation. A rupturable container retaining an alkaline processing composition containing a light absorbent (for example, carbon black) is positioned so that it is adjacent the top layer of the above described light-sensitive layer or transparent top sheet. This film unit is exposed to light through the transparent cover sheet and taken out of the camera, by which the container is ruptured by the pressing members, the processing composition (containing the light-shielding agent) is spread uniformly between the light-sensitive layer and the cover sheet. Thus film unit is shielded from light and the development proceeds.

Other useful film units of non-peel apart type embodiments capable of using DRR compounds or DDR couplers in the present invention are described in U.S. Pat. Nos. 3,415,644, 3,415,645, 3,415,646, 3,647,487 and 3,635,707 and German Patent Application (OLS) No. 2,426,980.

The following examples are given to illustrate the present invention in greater detail.

EXAMPLE 1

To a polyethylene terephthalate film having a thickness of 100μ, a neutralizing layer in the following manner (I) below and a cellulose acetate timing layer in the following manner (II) below were applied in turn. Further on the timing layer, the polymer latex was coated in the manner shown in Table A to prepare the timing layer according to the present invention. The coatings thus prepared are designated cover sheet Nos. 1 to 6.

TABLE A

| | | List of Photographic Elements for Evaluation | | |
|---|---|---|---|---|
| Cover Sheet No. | Polymer Latex No. | Latex Timing Layer Dry Thickness | Drying Condition of Latex-Coated Timing Layer | Remarks |
| 1 | (20) | 3 μ | 70° C. for 3 minutes followed by drying at 120° C. for 5 minutes | invention |
| 2 | (21) | 4 μ | 70° C. for 3 minutes followed by drying at 120° C. for 5 minutes | invention |
| 3 | (25) | 3 μ | 70° C. for 3 minutes followed by drying at 120° C. for 5 minutes | invention |
| 4 | (26) | 3 μ | 70° C. for 3 minutes followed by drying at 120° C. for 5 minutes | invention |
| 5 | (a) | 3 μ | 70° C. for 3 minutes followed by drying at 80° C. for 5 minutes | Comparison |
| 6 | (b) | 3 μ | 70° C. for 3 minutes followed by drying at 120° C. for 5 minutes | Comparison |

In Cover Sheet Nos. 5 and 6, the polymer latexes described in U.S. patent application Ser. No. 859,636 were used. The polymer latex (a) used in Cover Sheet No. 5 was a latex of styrene-butyl acrylate-acrylic acid copolymer (ratio by weight: 53.4:43.6:3) having a solid content of 15% by weight and the polymer latex (b) used in Cover Sheet No. 6 was a latex of styrene-butyl acrylate-acrylic acid copolymer (ratio by weight: 51.7:42.3:6) having a solid content of 15% by weight.

(I) Application of Neutralizing Layer 3.8 g of 5-(2-cyanoethylthio)-1-phenyltetrazole was dissolved in 1 kg of a 20% solution of acrylic acid-butyl acrylate copolymer (molar ratio 8:2) having an average molecular weight of 50,000 [solvent: acetone-water 3:1 (by volume)]. This solution was applied in an amount of 110 g per square meter using an extrusion coater and dried with dry air having a velocity of 5 m per second, a temperature of 120° C. and a dew point of 5° C. for 5 minutes to obtain a film having a thickness of about 20μ.

(II) Application of Cellulose Acetate Timing Layer 55 g of cellulose acetate having an acetylation degree of 52.1% (weight of acetic acid released by hydrolysis: 0.521 g per g of sample) (LM-70 produced by Daisel Ltd.) and 5 g of a styrene-maleic acid anhydride copolymer (molar ratio 1:1) having an average molecular weight of 10,000 were dissolved in a solvent mixture of acetone and cyclohexanone (vol ratio of 3:1). This solution was applied to the neutralizing layer produced by the method shown in (I) above in an amount of 50 g per square meter using an extrusion coater and dried with dry air having a velocity of 4 m per second, a temperature of 80° C. and a dew point of 5° C. to obtain a film having a thickness of about 2.6μ.

EXAMPLE 2

Each of Cover Sheet Nos. 1 to 6 prepared in Example 1 was placed face-to-face with a pH indicator coating film prepared by the method described in (III) below and an alkaline viscous solution prepared by the method shown in (IV) below was spread between them in a liquid thickness amount of 120μ. Then, the optical density was measured on the pH indicator coating film. The period of time required for reducing by half the reflection density of the high pH color (blue) of Thymolphthalein by neutralization (this period of time is presumed to be the period of time for reaching a pH of 10) at 25° C. and that at 15° C. were measured. The results of the tests are shown in Table B below.

(III) Production of pH Indicating Coating Film

To a polyethylene terephthalate film having a thickness of 180μ, a 7% solution of gelatin containing 28.5 mg of Thymolphthalein per g of gelatin [solvent: a mixture of water-methanol (4:1 by volume)] was applied in an amount of 100 g per square meter to form a film having a thickness of about 6.5μ. To the resulting film, a dispersion of titanium dioxide (solid content 10%) composed of 9 g of titanium dioxide per g of gelatin was applied in an amount of 300 g per square meter to form a white film having a dry thickness of about 9μ. Further, to the resulting film, the same solution of gelatin containing Thymolphthalein as described above was applied in the same manner and dried to complete the application.

(IV) Preparation of Viscous Alkaline Processing Solution 30 g of hydroxyethyl cellulose (Natrosol 250-HR, produced by Hercules, Inc.) and 30 g of sodium hydroxide were dissolved in 940 g of water with stirring and the solution was used after defoaming.

TABLE B

| Cover Sheet No. | Time(pH → 10) (minute) 25° C.($T_{25}$) | 15° C.($T_{15}$) | $T_{15}/T_{25}$ (%) | Remarks |
|---|---|---|---|---|
| 1 | 10.5 | 47.4 | 451 | Invention |
| 2 | 9.8 | 41.7 | 425 | Invention |
| 3 | 11.0 | 43.6 | 396 | Invention |
| 4 | 10.8 | 49.7 | 460 | Invention |
| 5 | 10.2 | 53.5 | 525 | Comparison |
| 6 | 10.0 | 56.1 | 510 | Comparison |

As is clear from a comparison of the values shown in Table B above, where the timing layer of the present invention is used, the temperature dependency of the alkaline permeability is substantially not different from that of comparison timing layer.

EXAMPLE 3

The processing temperature tolerance was examined for the photographic elements (Cover Sheet Nos. 1 to 6) prepared in Example 1 using the following photosensitive sheet (an image receiving element and a photosensitive element were applied to the same support) and a processing solution (processing element).

Production of Photosensitive Sheet

To a transparent polyethylene terephthalate support having a thickness of 180μ, the following layers were provided in turn:

(1) a layer comprising a mordanting agent (3.0 g/m²) of the following formula

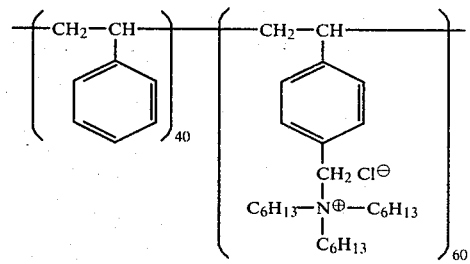

and gelatin (3.0 g/m²), (2) a layer comprising titanium dioxide (20 g/m²) and gelatin (2.0 g/m²), (3) a layer comprising carbon black (2.5 g/m²) and gelatin (2.5 g/m²), (4) a layer comprising cyan image forming material (0.50 g/m²) of the following formula

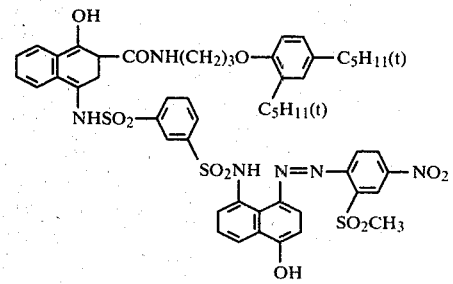

diethyl laurylamide (0.25 g/m²) and gelatin (1.14 g/m².)

(5) a layer comprising a red-sensitive internal latent image type direct reversal silver iodobromide emulsion (composition of halogen in silver halide: 2% by mol iodide; amount of silver: 1.9 g/m$^2$; gelatin: 1.4 g/m$^2$), a fogging agent (0.028 g/m$^2$) of the following formula

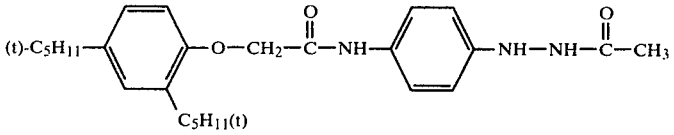

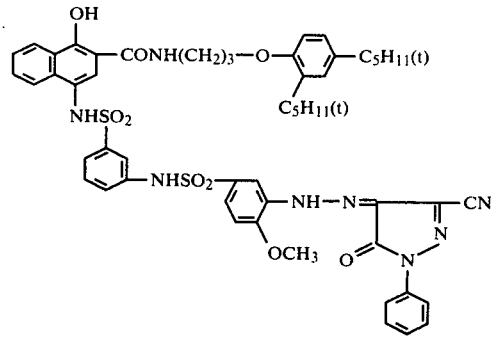

and sodium dodecylhydroquinone sulfonate (0.13 g/m$^2$), (6) a layer comprising gelatin (2.6 g/m$^2$) and 2,5-dioctylhydroquinone (1.0 g/m$^2$), (7) a layer comprising a magenta image forming material (0.45 g/m$^2$) of the following formula

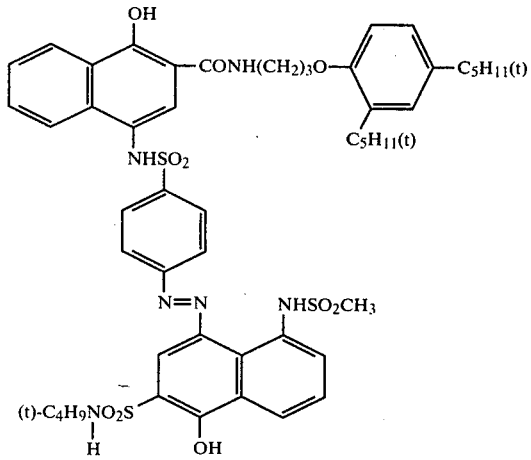

diethyl laurylamide (0.10 g/m$^2$), 2,5-di-t-butylhydroquinone (0.0074 g/m$^2$) and gelatin (0.76 g/m$^2$), (8) a layer comprising a green-sensitive internal latent image type direct reversal silver iodobormide emulsion (composition of halogen in silver iodobormide: 2% by mol iodide; amount of silver: 1.4 g/m$^2$; gelatin: 1.0 g/m$^2$), the same fogging agent as described for layer (5) (0.024 g/m$^2$) and sodium dodecylhydroquinone sulfonate (0.11 g/m$^2$), (9) a layer comprising gelatin (2.6 g/m$^2$) and 2,5-dioctylhydroquinone (1.0 g/m$^2$),

(10) a layer comprising a yellow image forming material (0.78 g/m$^2$) of the following formula diethyl laurylamide (0.16 g/m$^2$), 2,5-di-t-butylhydroquinone (0.012 g/m$^2$) and gelatin (0.78 g/m$^2$),

(11) a layer comprising a blue-sensitive internal latent image type direct reversal silver iodobromide emulsion (composition of halogen in silver iodobromide: 2% by mol iodide; amount of silver: 2.2 g/m$^2$; gelatin: 1.7 g/m$^2$), the same fogging agent as described for layer (5) (0.020 g/m$^2$) and sodium dodecylhydroquinone sulfonate (0.094 g/m$^2$), and

(12) a layer comprising gelatin (0.94 g/m$^2$).

Processing Solution:

1-Phenyl4-methyl-4-hydroxymethylpyrazolidinone: 10 g
Methylhydroquinone: 0.18 g
5-Methylbenzotriazole: 4.0 g
Sodium Sulfite (anhydrous): 1.0 g
Na Carboxymethylcellulose: 40.0 g
Carbon Black: 150 g
Potassium Hydroxide (28% aqueous solution): 200 cc
$H_2O$: 550 cc 0.8 g of the processing solution having the above described composition was placed in a container which was rupturable on pressing.

Processing

For evaluation the above-described cover sheet was superposed on the above-described photosensitive sheets. After exposure to light through the cover sheet using a color test chart, the above described processing solution was spread between both sheets in a liquid thickness of 85$\mu$. (Spreading was carried out using pressing rolls.) Processing was carried out at 25° C. and 15° C., respectively. After processing, the blue density, the green density and the red density formed on the image receiving layer were measured through the transparent support of the photosensitive sheet using a Macbeth reflection densitometer. (The measurement was carried out after a lapse of sufficient time for the image densities to reach equilibrium.) The values of the maximum transfer density in the optical density were shown in Table C below.

TABLE C

| Cover Sheet No. | Processing at 25° C. Blue Density ($D_B$) | Green Density ($D_G$) | Red Density ($D_R$) | Processing at 15° C. Blue Density ($D_B$) | Green Density ($D_G$) | Red Density ($D_R$) | Difference of Density between 15° C. and 25° C. $\Delta D_B$ | $\Delta D_G$ | $\Delta D_R$ | Remarks |
|---|---|---|---|---|---|---|---|---|---|---|
| 1 | 1.86 | 2.10 | 2.31 | 1.80 | 2.04 | 2.22 | 0.06 | 0.06 | 0.09 | Invention |
| 2 | 1.77 | 1.99 | 2.10 | 1.70 | 1.93 | 2.02 | 0.07 | 0.06 | 0.08 | Invention |
| 3 | 1.90 | 2.15 | 2.37 | 1.85 | 2.09 | 2.29 | 0.05 | 0.06 | 0.06 | Invention |
| 4 | 1.88 | 2.03 | 2.35 | 1.84 | 2.02 | 2.23 | 0.04 | 0.01 | 0.12 | Invention |
| 5 | 1.82 | 2.07 | 2.25 | 1.78 | 2.05 | 2.16 | 0.04 | 0.02 | 0.09 | Comparison |
| 6 | 1.80 | 2.04 | 2.20 | 1.75 | 2.00 | 2.10 | 0.05 | 0.04 | 0.10 | Comparison |

It can be seen from the results shown in Table C above that the difference of transfer density between 15° C. and 25° C. is substantially not observed in all of the cover sheets for evaluation.

Further, where the cover sheet were used for photographing a person as a model, the cover sheets according to the present invention showed sufficient processing temperature tolerance (a temperature ranging from 15° to 35° C.).

EXAMPLE 4

The timing layer coated surface of each of Cover Sheet Nos. 1 to 6 prepared in Example 1 and a adhesive coated surface of a heat seal film (a hot melt type adhesive was applied to a support) prepared in the following manner (V) below were placed in a face to face relation and put between two metal blocks heated at 120° C. for 1 minute.

(V) Production of Heat Seal Film

On a polyethylene terephthalate film having a thickness of 100μ, a heat melted polymer mixture having the following composition was laminated in an amount of 13.5 g per square meter to prepare a hot melt type adhesive layer.

| Composition of Hot Melt Type Adhesive | |
|---|---|
| Ethylene-Vinyl Acetate Copolymer (ratio by weight: 72:28) (EVA #220 produced by Mitsui Polychemical Co.) | 40 g |
| Partially Hydrogenated Rosin Ester (Estergum H prepared by Arakawa Ringyo Co.) | 40 g |
| Paraffin Wax (melting point: 145° F.) | 20 g |

The film units thus prepared and those which had been maintained in an aging tester of 50° C., 80% relative humidity for 1 day were subjected to adhesion strength measurements using a stretching tester. The results obtained are shown in Table D below.

TABLE D

| Cover Sheet No. | Before Aging Test Friction Strength (g/cm) | Portion where peeling occurred | After Aging Test Friction Strength (g/cm) | Portion where peeling occurred | Remarks |
|---|---|---|---|---|---|
| 1 | 826 | Inside of Adhesive Polymer Layer | 750 | Between Adhesive and Latex Timing Layer | Invention |
| 2 | 815 | Inside of Adhesive Polymer Layer | 760 | Between Adhesive and Latex Timing Layer | Invention |
| 3 | 831 | Inside of Adhesive Polymer Layer | 775 | Between Adhesive and Latex Timing Layer | Invention |
| 4 | 822 | Inside of Adhesive Polymer Layer | 768 | Between Adhesive and Latex Timing Layer | Invention |
| 5 | 786 | Between Adhesive and Latex Timing Layer | 45 | Between Latex Timing Layer and Cellulose Acetate Timing Layer | Comparison |
| 6 | 772 | Between Adhesive and Latex Timing Layer | 41 | Between Latex Timing Layer and Cellulose Acetate Timing layer | Comparison |

It can be seen from the results shown in Table D above that when the cover sheets according to the present invention, Nos. 1 to 4, having the latex timing layer of the present invention are used, the decrease in adhesion strength after aging test is very small. On the contrary, in using cover sheets for comparison, Nos. 5 and 6, the adhesion strength decreases drastically, i.e., peeling off occurres between cellulose acetae timing layer and latex timing layer after aging test.

EXAMPLE 5

In the same manner as Example 1 polymer latex Nos. 37, 38, 18, 19, (c), (d), (e) or (f) was coated on the cellulose acetate timing layer prepared in Example 1 to prepare cover sheet Nos. 7 to 14 under the conditions shown in Table E below.

TABLE E

| List of Photographic Elements for Evaluation | | | | |
|---|---|---|---|---|
| Cover Sheet No. | Polymer Latex No. | Latex Timing Layer Dry Thickness | Drying Condition of Latex-Coated Timing Layer | Remarks |
| 7 | (37) | 3 μ | 70° C. for 3 minutes followed by drying at 120° C. for 5 minutes | Invention |
| 8 | (c) | 3 μ | 70° C. for 3 minutes followed by drying at 120° C. for 5 minutes | Comparison |
| 9 | (38) | 3 μ | 70° C. for 3 minutes followed by drying at 120° C. for 5 minutes | Invention |
| 10 | (d) | 3 μ | 70° C. for 3 minutes followed by drying at 120° C. for 5 minutes | Comparison |
| 11 | (18) | 3 μ | 70° C. for 3 minutes followed by drying at | Invention |

TABLE E-continued

| List of Photographic Elements for Evaluation | | | | |
|---|---|---|---|---|
| Cover Sheet No. | Polymer Latex No. | Latex Timing Layer Dry Thickness | Drying Condition of Latex-Coated Timing Layer | Remarks |
| 12 | (e) | 3 μ | 120° C. for 5 minutes 70° C. for 3 minutes followed by drying at 120° C. for 5 minutes | Comparison |
| 13 | (19) | 4 μ | 70° C. for 3 minutes followed by drying at 120° C. for 5 minutes | Invention |
| 14 | (f) | 4 μ | 70° C. for 3 minutes followed by drying at 120° C. for 5 minutes | Comparison |

Note:
Polymer latex No. (c):
n-Butyl methacrylate-acrylic acid-2-hydroxy-3-chloropropyl acrylate copolymer (82.5:2:5:15)
Polymer latex No. (d):
Ethyl methacrylate-itaconic acid-2-hydroxy-3-chloropyl methacrylate copolymer (90:2:8)
Polymer latex No. (e):
Styrene-n-butyl acrylate-acrylic acid-3-propyl acrylate copolymer(47.9:38.1:2:12)
Polymer latex No. (f):
Styrene-n-butyl acrylate-acrylic acid-3-propyl acrylate copolymer (43:43:4:10)
Polymer latex Nos. (c), (d), (e) and (f) contain a monomer having a glycidyl precursor group corresponding to the glycidyl group containing monomer contained in polymer latex Nos. 37, 38, 18 and 19, respectively.

These cover sheets were treated in the same manner as Example 4 to prepare film units the adhesion strength of which was measured in the same manner as Example 4. The results obtained are shown in Table F below.

TABLE F

| | Before Aging Test | | After Aging Test | | |
|---|---|---|---|---|---|
| Cover Sheet No. | Friction Strength (g/cm) | Portion Where Peeling Occurred | Friction Strength (g/cm) | Portion Where Peeling Occurred | Remarks |
| 7 | 825 | Inside of Adhesive Polymer Layer | 778 | Between Adhesive and Latex Timing Layer | Invention |
| 8 | 821 | Inside of Adhesive Polymer Layer | 420 | Between Adhesive and Latex Timing Layer | Comparison |
| 9 | 819 | Inside of Adhesive Polymer Layer | 769 | Between Adhesive and Latex Timing Layer | Invention |
| 10 | 816 | Inside of Adhesive Polymer Layer | 393 | Between Adhesive and Latex Timing Layer | Comparison |
| 11 | 826 | Inside of Adhesive Polymer Layer | 750 | Between Adhesive and Latex Timing Layer | Invention |
| 12 | 813 | Inside of Adhesive Polymer Layer | 381 | Between Adhesive and Latex Timing Layer | Invention |
| 13 | 815 | Inside of Adhesive Polymer Layer | 760 | Between Adhesive and Latex Timing Layer | Invention |
| 14 | 818 | Inside of Adhesive Polymer Layer | 339 | Between Adhesive and Latex Timing Layer | Comparison |

From the results shown in Table F above, it can be seen that copolymers having a glycidyl group exhibited substantially the same level of friction strength prior to aging test as compared with copolymers having a corresponding glycidyl precursor group while the former showed a much lower decrease in adhesion strength after aging test than the latter.

While the invention has been described in detail and with reference to specific embodiments thereof, it will be apparent to one skilled in the art that various changes and modifications can be made therein without departing from the spirit and scope thereof.

What is claimed is:

1. In a photographic element for the color diffusion transfer process including a neutralizing system for reducing the pH of an aqueous alkaline developing solution which comprises a neutralizing layer and a timing layer, wherein the timing layer is positioned on or under the neutralizing layer in direct or indirect contact therewith such that the aqueous alkaline developing solution reaches the neutralizing layer through the timing layer, the improvement which comprises a timing layer comprising a polymer which is produced by emulsion polymerization of (1) each of (A) at least one monomer selected from the group consisting of ethylene-type monomers having at least one free carboxylic acid group, free sulfonic acid group or free phosphoric acid group or a salt thereof, (B) at least one monomer selected from the group consisting of monomers represented by the following general formula (I)

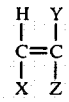

(I)

wherein X is a hydrogen atom, a methyl group or a $-COOR^1$ group; Y is a hydrogen atom, a methyl group or a $-(CH_2)_nCOOR^2$ group; Z is a monocyclic or bicyclic aryl group having 6 to 12 carbon atoms, a $-COOR^3$ group or a $-OCR^3$ (O) group;

$R^1$, $R^2$ and $R^3$, which may be the same or different, each represents a saturated aliphatic group having 1 to 12 carbon atoms or a monocyclic or bicyclic aryl group having 6 to 12 carbon atoms; and n is an integer of 0 to 3, and (C) at least one monomer selected from the group consisting of ethylene-type monomers having at least one glycidyl group or (2) each of (A) at least one monomer selected from the group consisting of the ethylene-type monomers described in (A) above, (B) at least one monomer selected from the group consisting of monomers represented by the general formula (I) above, (C) at least one monomer selected from the group consisting of the ethylene-type monomers described in (C) above, and (D) at least one monomer selected from the group consisting of monofunctional or polyfunctional unsaturated monomers other than those monomers described in (A), (B) and (C) above which are copolymerizable with the monomers described in (A), (B) and (C) above and selected from the group consisting of acrylamides, methacrylamides, vinyl ethers, vinyl ketones, allyl compounds, olefins, vinyl heterocyclic compounds, unsaturated nitriles and polyfunctional monomers, and the polymer latex layer per se has the water permeability.

2. The photographic element of claim 1, wherein said photographic element is a cover sheet for a color diffusion transfer photographic material.

3. The photographic element of claim 1, wherein the photographic element is a laminate integral color diffusion transfer film unit which comprises a photosensitive member comprising an image receiving element and a photosensitive element coated in turn on a support, a cover sheet including said neutralizing system, and a processing element comprising an aqueous alkaline processing solution capable of being spread between said photosensitive element and said cover sheet.

4. The photographic element of claim 3, wherein said elements are strippable elements.

5. The photographic element of claim 3, wherein said photosensitive element contains at least one silver halide photographic emulsion layer and a dye image forming material associated therewith.

6. The photographic element of claim 5, wherein said dye image forming material is present in a layer adjacent said photographic emulsion layer.

7. The photographic element of claim 5, wherein said dye image forming material is a compound capable of being oxidized by an oxidation product of a developing agent and releasing a diffusible dye.

8. The photographic element of claim 5, wherein said photographic emulsion is a direct reversal photographic emulsion.

9. The photographic element of claim 8, wherein said direct reversal photographic emulsion is an internal latent image type direct reversal photographic emulsion.

10. The photographic element of claim 9, wherein the internal latent image type emulsion is an internal latent image type emulsion comprising a core and a shell.

11. The photographic element of claim 7, wherein said photographic material includes a direct reversal photographic emulsion layer and said dye image forming material is combined with said direct reversal photographic emulsion layer.

12. The photographic element of claim 1, wherein said polymer latex of said timing layer is a latex free of water-soluble materials other than surface active agents, either during preparation of said latex or said timing layer.

13. The photographic element of claim 1, wherein said neutralizing system has a $T_{15}/T_{25}$ value in percent ranging from about 250% to about 600%, wherein $T_{15}$ is the time required for reducing the pH of the alkaline processing solution to 10° at 15° C. and $T_{25}$ is the period of time required for reducing the pH of the alkaline processing solution to 10° at 25° C.

14. The photographic element of claim 13, wherein the $T_{15}/T_{25}$ value in percent range from 300 to 500%.

15. The photographic element of claim 1, wherein said monomer represented by the general formula (I) is styrene.

16. The photographic element of claim 1, wherein said monomer represented by the general formula (I) is butyl acrylate.

17. The photographic element of claim 1, wherein said monomer represented by the general formula (I) is butylmethacrylate.

18. The photographic element of claim 1, wherein said monomer (C) is glycidyl acrylate.

19. The photographic element of claim 1, wherein said monomer (C) is glycidyl methacrylate.

* * * * *